US006184871B1

(12) United States Patent
Terés et al.

(10) Patent No.: US 6,184,871 B1
(45) **Date of Patent: *Feb. 6, 2001**

(54) IDENTIFICATION DEVICE OF A MANUAL ACTION ON A SURFACE, IN PARTICULAR FOR A TIMEPLACE

(75) Inventors: Yvan Terés, Cressier; Hugues Vuilléme, Saint-Aubin; Joachim Grupp, Neuchâtel, all of (CH)

(73) Assignee: Asulab S.A., Bienne (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/953,295

(22) Filed: Oct. 17, 1997

(30) Foreign Application Priority Data

Oct. 25, 1996 (FR) ..... 96 13061

(51) Int. Cl.[7] ..... G09G 5/00
(52) U.S. Cl. ..... 345/173; 178/18.06
(58) Field of Search ..... 345/173, 174; 178/18.01, 18.05, 18.06, 18.07, 18.1

(56) References Cited

U.S. PATENT DOCUMENTS 3,696,409 * 10/1972 Braaten ..... 345/173
4,507,523 * 3/1985 Gohara et al. ..... 178/19
4,529,968 * 7/1985 Hilsum et al. ..... 340/635
4,658,373 * 4/1987 Murakami et al. ..... 364/478.01
4,766,389 8/1988 Roades et al. .
4,853,498 * 8/1989 Meadows et al. ..... 345/174
5,134,689 * 7/1992 Murakami et al. ..... 178/19
5,543,588 * 8/1996 Bisset et al. ..... 345/173
5,638,093 * 6/1997 Takahashi et al. ..... 345/173
5,693,914 * 12/1997 Ogawa ..... 345/173
5,717,432 * 2/1998 Miwa et al. ..... 345/173
5,777,605 * 7/1998 Yoshinobu et al. ..... 345/173
5,801,340 * 9/1998 Peter ..... 178/20.04

FOREIGN PATENT DOCUMENTS 289427 11/1988 (EP) .
572368 12/1993 (EP) .

OTHER PUBLICATIONS

Bulletin Annuel De La Societe Suisse De Chronometrie Et Du Laboratoire Suisse De Recherche Horlogeres, vol. 7, No. 4, 1978, Neuchatel, pp. 499–502, C. Piguet et J.F. Perotto: Nouvelles Possibilities D'Entree Des Donnees Dans Une Montre.

* cited by examiner

*Primary Examiner*—Kent Chang
(74) *Attorney, Agent, or Firm*—Sughrue, Mion, Zinn, Macpeak & Seas, PLLC

(57) ABSTRACT

Device arranged to identify a manual action on a surface performed by a finger (32), comprising a set of sensors (41) each actuable by the finger so as to create a variation of an electrical quantity, these sensors being respectively arranged within a corresponding set of determined zones of the surface. The device further comprises first detection means (42) for detecting, amongst a subset of said sensors (41) which are activated simultaneously, that actuated sensor representing the greatest variation of the electrical quantity.

5 Claims, 4 Drawing Sheets

1
2
3
4
5
6
7
8
9
10
11
12
13
14
15
16
17
18
19
20
21
22
0
1
2
3
4
5
6
7
8
9
%
.

IDENTIFICATION DEVICE OF A MANUAL ACTION ON A SURFACE, IN PARTICULAR FOR A TIMEPLACE

BACKGROUND OF THE INVENTION

The present invention concerns an identification device of a manual action on a surface performed by a finger and, more specifically, it concerns such device comprising a set of sensors which are each actuable by the finger of a user so as to create a variation of an electrical quantity. Such device may be used in horological applications, such as a wristwatch comprising a recognition device for recognising characters drawn manually on the glass of the watch. It should however be understood that the invention is not limited to this application.

Watches comprising identification devices such as defined hereabove are already known. The document EP-A-0 165 548 describes an electronic watch comprising a recognition device of characters drawn manually on the glass of a watch. A matrix of photoelectrical sensors is arranged on the bottom surface of the glass. When the user draws a character on the top surface of the glass, the intensity of the light detected by the photoelectrical sensors is modified, which then thus allows the detection of the coordinates of the transcribed character. The written character is then recognised according to the detected coordinates. To do this, the respective coordinates of the lines forming the drawn character are memorised in a memory device. These coordinates are compared to reference coordinates which are also memorised in the memory device so as to find the reference coordinates which are the most similar to the coordinates corresponding to the character written on the glass. When the user draws this character, it often happens that several sensors are activated simultaneously. So as to be capable of determining the coordinates of the drawn character, it is thus necessary to calculate the center of gravity of the group of sensors which are activated at the same time by the user.

The calculation of the center of gravity often presents several inconveniences. On the one hand, the processing of data necessary for taking into account factors such as the diametrical disposition of the actuated sensors, is a complex task which imposes a high burden on the data processing circuit associated to these sensors and which leads to a slow response time of this circuit. On the other hand, the result of this calculation often lacks precision, which leads to recognitions errors of characters written by the user.

SUMMARY OF THE INVENTION

The present invention thus has as its principal object to provide an identification device of a manual action on a surface formed by a finger which overcomes, at least in part, the inconveniences of the prior art.

The invention also has as an object to provide such a device which is simple and efficient, which presents high reliability, which uses little energy and which is more suitable for use in an electronic watch than the devices of the prior art.

The invention thus has as an object a device for identifying a manual action on a surface performed by a finger comprising a set of sensors each being actuable by said finger so as to create a variation of an electric quantity, these sensors being respectively arranged within a corresponding set of determined zones of said surface; characterised in that said device further comprises :

first detection means for detecting, amongst a subset of said sensors which are activated simultaneously, the actuated sensor which has the largest variation of said electrical quantity.

Thanks to these features, the data processing necessary for identifying the manual action, such as the writing of a character performed on a given surface is considerably simplified. Furthermore, such device presents a high precision with respect to prior devices.

Other features and advantages of the invention will become more clear when reading the following description which will be made of an embodiment of the invention and which is given solely by way of example thereby referring to the attached drawings in which:

DESCRIPTION OF PREFERRED EMBODIMENTS

Figure 1:
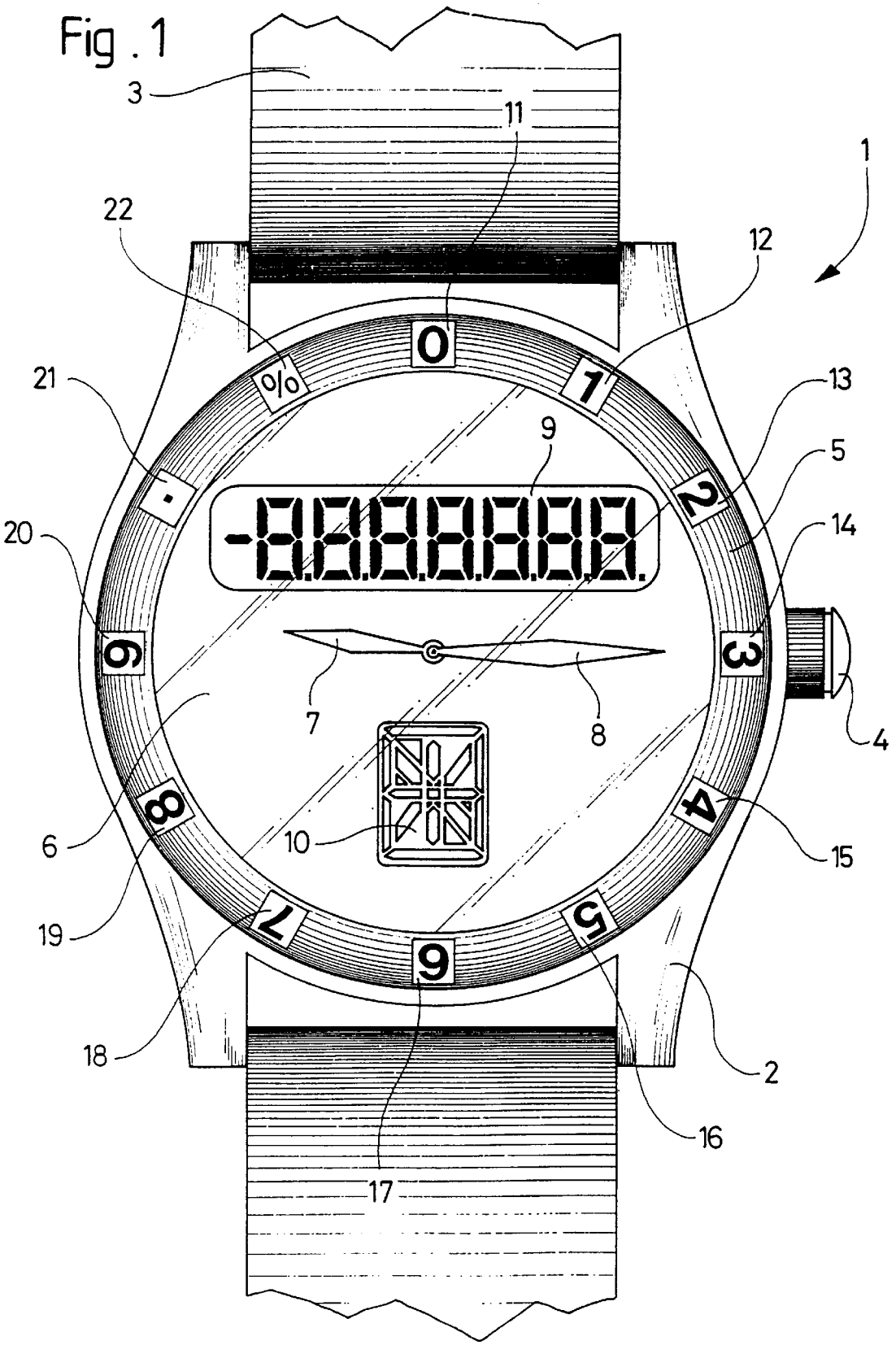
FIG. 1 is a plan view of a watch comprising an identification device according to the present invention.

Reference will now be made to FIG. 1, in which is shown a watch 1 comprising a case 2, a bracelet 3, a crown 4, a bezel 5, a glass 6, hour and minute hands 7 and 8 and two numerical display devices 9 and 10. Furthermore, discrete capacitive sensors, referenced 11 to 22 may be arranged around bezel 5 or glass 6.

Figure 2:
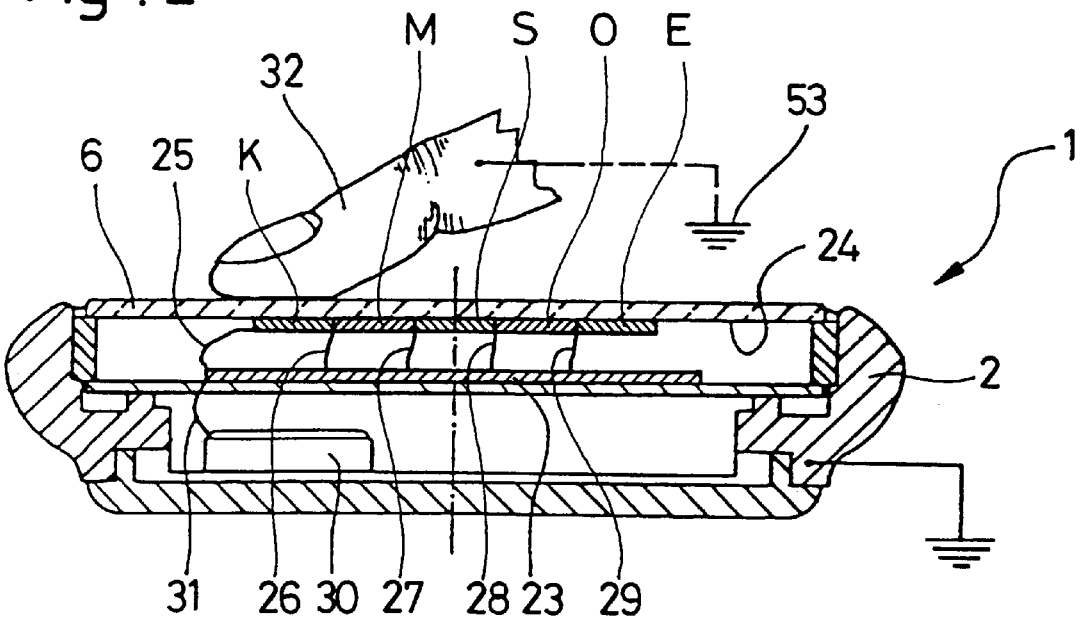
FIG. 2 is a cross-section of the watch of FIG. 1.

FIG. 2 shows a cross-section of watch 1. An electronic circuit 23 is arranged in case 2. A set of conducting electrodes, preferably transparent, are arranged on the interior face 24 of glass 6. Only five of these electrodes, respectively referenced K, M, S, O and E are represented in FIG. 2. Electrodes K to E are connected to electronic circuit 23 by conductors 25 to 29 respectively. A battery or another electric energy source is also arranged in case 2 and is connected to the positive terminal of electronic circuit 23 by a conductor 31.

Each of electrodes K to E form one of the electrodes of a series of capacitive sensors, the other electrode of each of these capacitive sensors being formed by the finger 32 of the wearer of watch 1 when he touches the exterior of glass 6 on a determined zone opposite a particular electrode. Finger 32 of the wearer is connected to the ground of electronic circuit 33 by intermediate of case 2 which is in contact with the wrist of the wearer and which is respectively connected to the negative pole of electronic circuit 23 and of battery 30.

Figure 3:
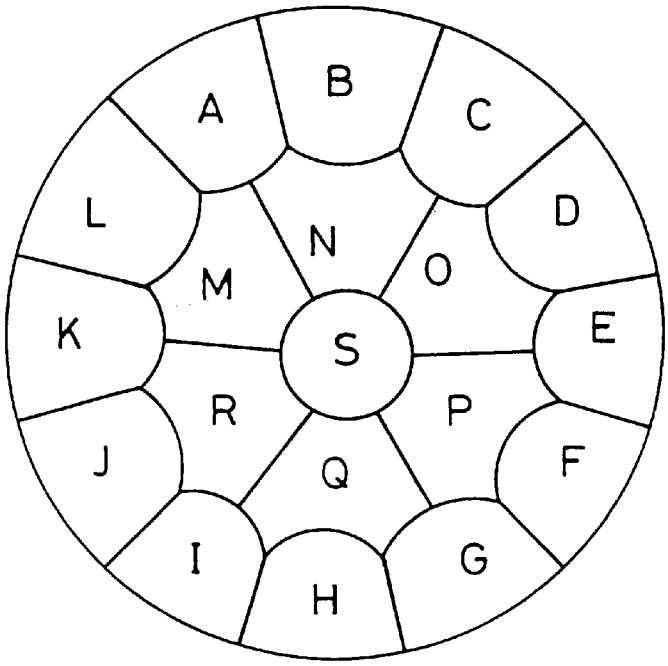
FIG. 3 is a schematic representation of the spatial arrangement of the sensors of the identification device forming part of the watch of FIG. 1.

FIG. 3 shows the spatial arrangement of the set of electrodes arranged below glass 6 of watch 1 of which these electrodes form part. The set of sensors of which these electrodes form a part, are each actuable by finger 32 in such a way so as to create a variation of its capacity. This set of sensors is respectively arranged within a corresponding set of determined zones of the surrounding surface of glass 6.

Figure 4:
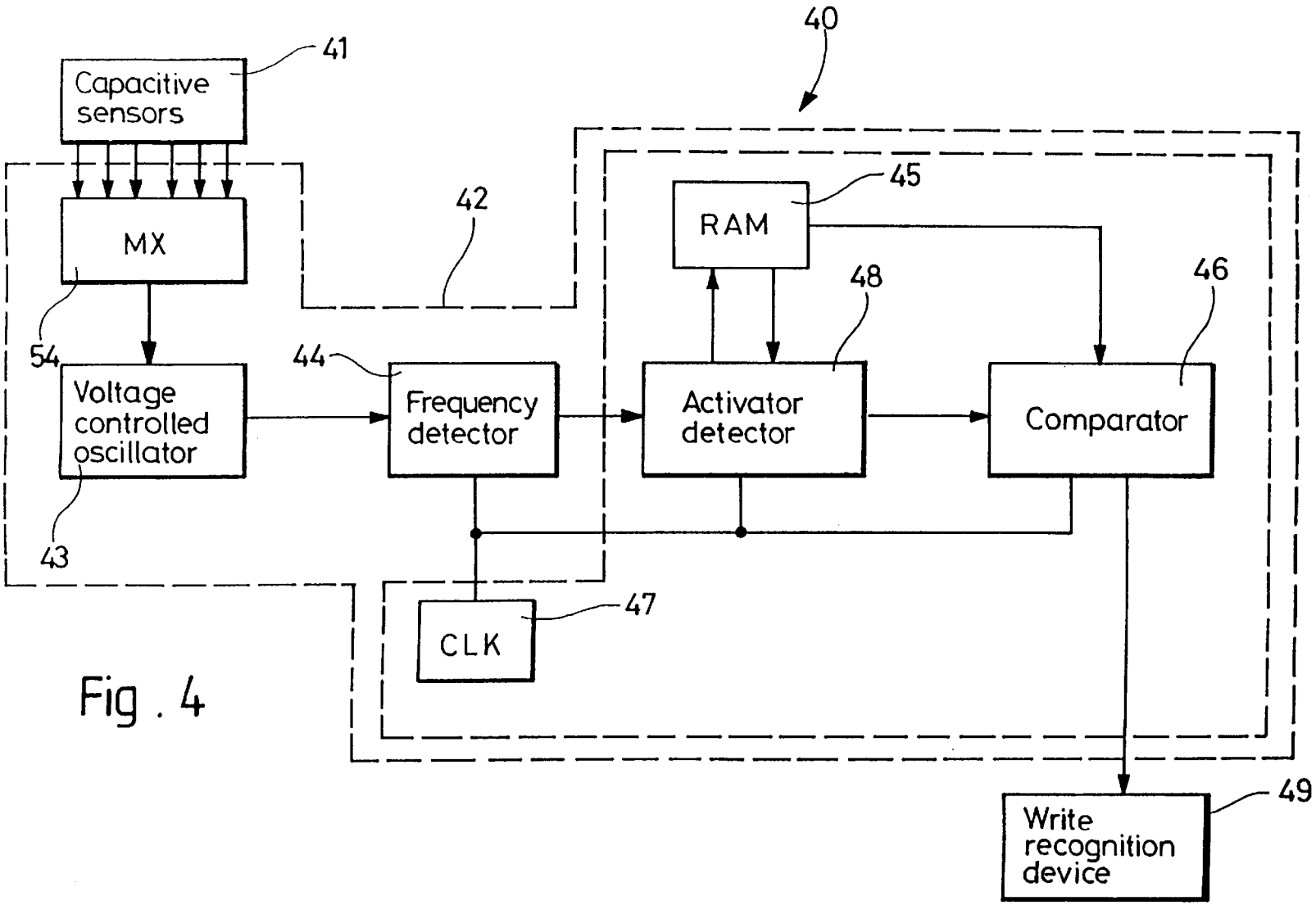
FIG. 4 represents a bloc diagram of an identification device arranged to be used in the watch of FIG. 1.

FIG. 4 represents a schematic diagram of an embodiment of the identification device 40 used in watch 1 of FIG. 1 and which allows to determine which sensor is most active amongst those which are below the contact surface of the finger of the user resting on the exterior surface of glass 6. Identification device 40 comprises a set of capacitive captors 41 which are all connected to detection means of that activated sensor which, amongst a subset of sensors 41 which are actuated simultaneously by the user, represents the largest variation of its capacity. Although the present embodiment comprises capacitive sensors, it should be noted that it is possible to use other types of sensors presenting a variation of an electrical quantity when they are activated, such as a capacity or a resistance for example.

Figure 5:
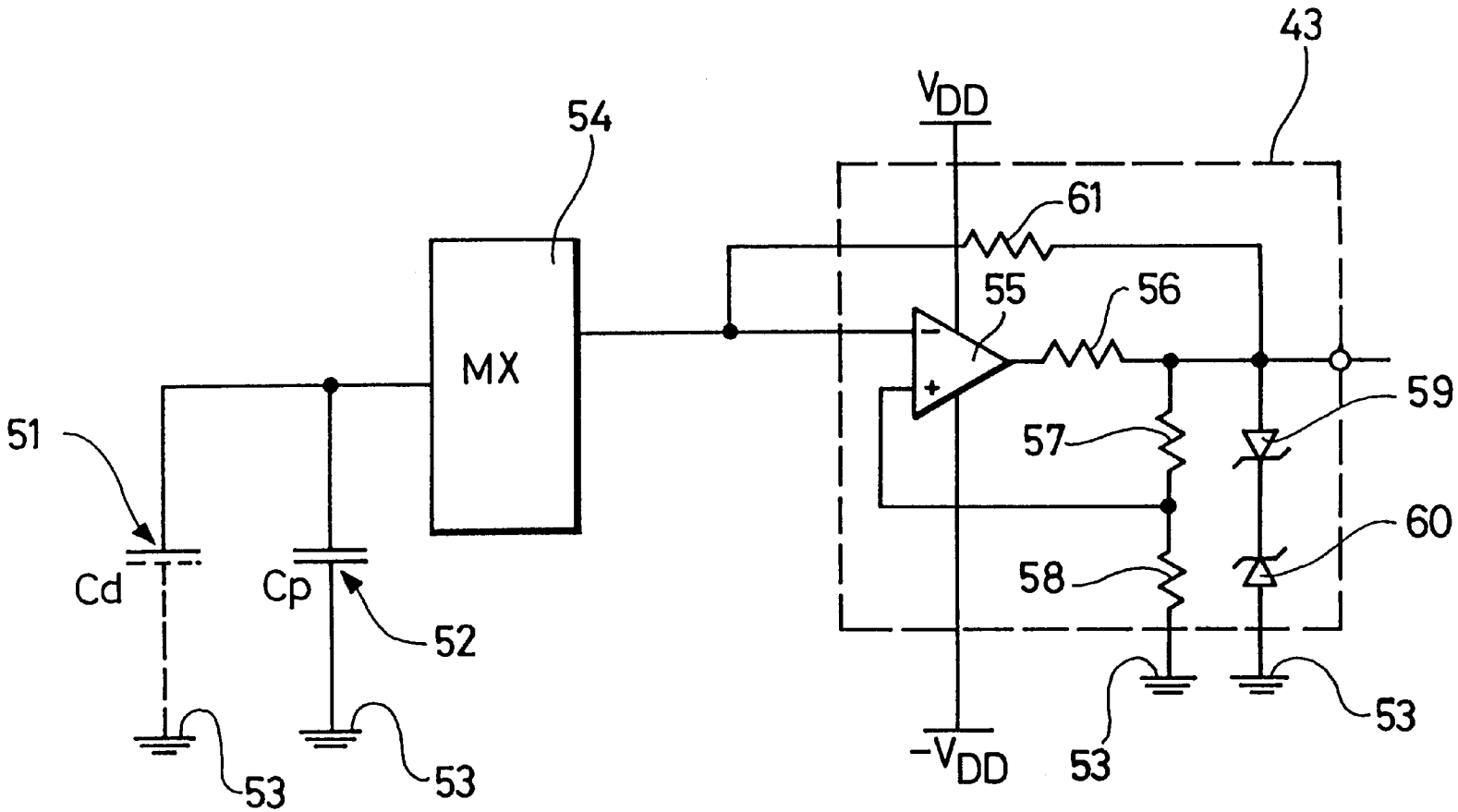
FIG. 5 shows a detailed circuit of one of the sensors as well as a part of the circuit of the identification device of the watch represented in FIG. 1.

FIG. 5 shows a circuit which will be used to describe the functioning of the capacitive sensor device 41 according to the invention. Each capacitive sensor, only one being represented in FIG. 5, comprises a capacitor 51 whose electrodes are formed, on the one hand, by the fixed electrodes on the inside surface of glass 6 and, on the other hand, by the finger 32 of the user.

Furthermore, a parasite capacitor 52 is also formed by the present construction between the mentioned fixed electrode and case 2 of watch 1. Capacitive sensor 51 and parasite capacitor 52 are connected in parallel between ground 53 and the input of a multiplexor 54.

The means for detecting the activated sensor representing the greatest variation of electrical quantity comprises conversion means of the total capacity of the set of the fixed capacitor and the parasite capacitor of each capacitive sensor A to S into an output signal having a frequency proportional to this total capacity. These means comprise, in this example, the multiplexer 54 and a voltage controlled oscillator 43. Multiplexer 54 is arranged to successively connect each capacitive sensor A to S to the input of the voltage controlled oscillator 43. As can be seen in FIG. 5, when they are thus connected, capacitors 51 and 52 are connected in parallel between ground 53 and the inverted input of an operational amplifier 55 forming part of the voltage controlled oscillator 43.

Voltage controlled oscillator 43 also comprises resistors 56, 57 and 58 which are all connected in series between the output amplifier 55 and ground 53. The non-inverting input of amplifier 55 is connected to a junction between resistors 57 and 58. In this configuration, amplifier 55 and resistors 56 to 58 form a Schmidt-trigger which provides at its output, i.e. at the junction between resistors 56 and 57, a signal having an amplitude which is a function of the relative values of the voltages present at the inverting input and the non-inverting input of amplifier 55, either at a high logic level or a low logic level. Two zener diodes 59 and 60 arranged head-to-tails are connected between the output of amplifier 55 and ground 53 so as to stabilize the voltages which respectively define these logical levels. The voltage controlled oscillator 43 further comprises a resistance 61 connected between the output of the Schmidt-trigger and the inverting input of the amplifier. This resistance forms part of, together with capacitors 51 and 52, a low-pass filter which integrates the voltage at the output of the Schmidt trigger. The potential at the electrodes of capacitors 51 and 52 is applied to the inverting input of amplifier 55.

The oscillation frequency of the output signal of the voltage controlled oscillator 43 is proportional to the inverse of the total capacity of the two capacitors 51 and 52 which are connected in parallel. Thus, the oscillating frequency of voltage controlled oscillator 43 varies as a function of the presence or the absence of finger 32 of the user on the exterior face of glass 6. If finger 32 of the wearer of the watch is not positioned on glass 6, one of the electrodes of capacitor 51 is consequently absent from the circuit shown in FIG. 5. The total capacity is in this case equivalent to the capacity of parasite capacitor 52 and the oscillating frequency of the output signal of voltage control oscillator 43 is proportional to the inverse of this capacity.

On the contrary, when finger 32 is placed on glass 6, capacitor 51 does effectively act on the input of the voltage controlled oscillator. Under these conditions, the total capacity is equivalent to the sum of the capacities of the above capacitors 51 and 52. Thus, the oscillation frequency of the output signal of voltage controlled oscillator 43 is proportional to the sum of the capacities of these two capacitors.

When the user places his finger 32 on the exterior surface of glass 6 to draw, for example, a character, his finger is positioned opposite several electrodes A to S. Thus, he simultaneously increases the capacity of a group of these sensors. In order to be able to determine the coordinates of a written character on the glass, it is necessary to determine which of these sensors has the largest capacity variation.

Well, it has been observed that the coverage of the electrodes forming part of this group by finger 32 is not the same for each electrode. The coverage of the discrete zone of the exterior surface of glass 6 opposite each electrode varies in fact between 0 and 100% according to the position of the finger. Thus, although capacitor 51 is formed when finger 32 is positioned on glass 6 opposite the electrode in question, the value of its capacity varies as a function of the degree of coverage of this electrode by finger 32.

The identification device according to the present invention benefits from this observation and chooses as the only active sensor that one whose capacitive variation is the largest.

To this effect, the identification device 40 further comprises means for detecting the output signal of the voltage controlled oscillator having the largest frequency variation. These means for detecting the output signal comprise a frequency detector 44 (see FIG. 4), a memory device 45 and a comparator 46. The functioning of the frequency detector 44, of memory device 45 and of comparator 46 are all controlled at a pace determined by the frequency of clock pulses coming from a clock circuit 47.

The frequency detector 44 may be obtained by a pulse counter which is activated during a fixed functioning period. In this case, the frequency of each output signal of voltage controlled oscillator 43 is represented directly by the number of pulses received during this fixed period. As a result, frequency detector 44 creates a numerical value, i.e. the contents of the counter, corresponding to the frequency of the output signal corresponding to each sensor.

Preferably, identification device 40 further comprises an activation detector 48 which is connected to the output of frequency detector 44 so that it receives binary words which stem from this latter. Activation detector 48 compares each binary word to a predetermined reference threshold corresponding to a capacity value indicating whether a capacitive sensor was indeed activated by the user.

If this is the case, this binary word is then stored in memory device 45. When the set of capacitive sensors A to S have thus been sampled and when the corresponding binary words of each capacitive sensor group activated by the user during this sweep have been stored in memory device 45, comparator 46 is arranged to compare the numerical values of these binary words and to identify that numerical value which corresponds to the capacitive sensor having the largest capacity variation. An output signal corresponding to this sensor is then provided to a writing recognition device 49 or to another exploitation circuit.

Finally, it should be noted that several modifications may be applied to the identification device according to the invention without parting from the scope of this invention.

For example, although capacitive sensors are provided in the embodiment described hereabove, any other sensor which is capable of representing a variation of an electrical quantity when it is activated may be used. Furthermore, the invention may be applied not only to a set of sensors associated to the glass of a watch or of another writing or other manually controlled device, but it may also be applied to several other applications. For example, the sensors may also be arranged not only on the glass, but at the periphery below bezel 13. Furthermore, the invention is applicable to each manually controlled device, i.e. in applications in which push-buttons or any other new control devices may be replaced by the sensors such as described hereabove.

What is claimed is:

1. A device for identifying a manual action on a surface performed by a finger, comprising:

a set of sensors each being actuable by said finger so as to create a variation of an electric quantity, said electrical quantity varying as a function of degree of coverage of the sensor by said finger, these sensors being independent and distinct from each other and respectively arranged within a corresponding set of determined zones of said surface;

wherein said device further comprises:

first detection means for detecting, amongst a subset of said sensors which are activated simultaneously, the actuated sensor which has the largest variation of said electrical quantity.

2. The device according to claim 1, wherein said first detection means comprise:

means for converting said electrical quantity of each of said set of sensors into an output signal having a frequency which is proportional to said electrical quantity, and second detection means for detecting the output signal which has the largest frequency variation.

3. A device according to claim 2, wherein said second detection means comprise a frequency detector for creating a numerical value corresponding to the frequency of the output signal corresponding to each activated sensor, a memory for memorising said numerical values, and a comparator for comparing said numerical values and for identifying that one which corresponds to the sensor having the largest variation of said electrical quantity.

4. A device according to claims 1, 2, or 3, wherein said device further comprises :

an activation detector for detecting if the variation of said electrical quantity of at least one of said set of sensors reaches a predetermined threshold.

5. A device according to claim 1, wherein said sensors are capacitive sensors comprising first and second electrodes and said electrical quantity is a capacity of said capacitive sensors, the first electrode of each sensor being formed on a face of said surface opposite to a face in contact with said finger and the second electrode of each sensor being formed by said finger.

* * * * *